US010605027B2

(12) United States Patent
Walton et al.

(10) Patent No.: US 10,605,027 B2
(45) Date of Patent: Mar. 31, 2020

(54) RETAINING SEALING ELEMENT OF WELLBORE ISOLATION DEVICE WITH SLIP ELEMENTS

(71) Applicant: Halliburton Energy Services, Inc., Houston, TX (US)

(72) Inventors: Zachary William Walton, Carrollton, TX (US); Michael Linley Fripp, Carrollton, TX (US); Michael James Jurgensmeier, Duncan, OK (US); John C. Gano, Lowry Crossing, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/777,007

(22) PCT Filed: Jan. 21, 2016

(86) PCT No.: PCT/US2016/014225

§ 371 (c)(1),
(2) Date: May 17, 2018

(87) PCT Pub. No.: WO2017/127075

PCT Pub. Date: Jul. 27, 2017

(65) Prior Publication Data

US 2018/0328132 A1 Nov. 15, 2018

(51) Int. Cl.
*E21B 23/06* (2006.01)
*E21B 33/12* (2006.01)
(Continued)

(52) U.S. Cl.
CPC ..... *E21B 29/02* (2013.01); *E21B 23/06* (2013.01); *E21B 33/128* (2013.01);
(Continued)

(58) Field of Classification Search
CPC ..... E21B 23/06; E21B 33/12; E21B 33/1208; E21B 33/129; E21B 29/02
See application file for complete search history.

(56) References Cited

U.S. PATENT DOCUMENTS 8,066,065 B2 11/2011 Buckner
8,459,347 B2 6/2013 Stout
(Continued)

FOREIGN PATENT DOCUMENTS

CA 2755102 4/2012

OTHER PUBLICATIONS

International Search Report and the Written Opinion of the International Search Authority, or the Declaration, dated Oct. 4, 2016, PCT/US2016/014225, 18 pages, ISA/KR.
(Continued)

*Primary Examiner* — Cathleen R Hutchins
(74) *Attorney, Agent, or Firm* — Haynes and Boone, LLP

(57) ABSTRACT

A downhole wellbore isolation tool includes an elastomeric sealing element for engaging a casing member or another tubular member in a wellbore. The isolation tool includes one or more expandable slips for gripping the tubular member and holding the isolation tool in place. The sealing element has an axial end in direct contact with an abutment surface of the expandable slip such that the slip limits, if not eliminates, unwanted extrusion of the sealing element, e.g., upon setting of the isolation tool. The expandable slips may be constructed of a plurality of slip elements, and the elastomeric sealing element may flow into gaps defined between the slip elements when the isolation tool is set. The slip segments and other components of the isolation tool may be constructed of a dissolvable material to facilitate removal of the isolation tool from the wellbore.

16 Claims, 5 Drawing Sheets

(51) Int. Cl.
*E21B 33/129* (2006.01)
*E21B 29/02* (2006.01)
*E21B 33/128* (2006.01)

(52) U.S. Cl.
CPC ..... *E21B 33/1208* (2013.01); *E21B 33/1285* (2013.01); *E21B 33/1293* (2013.01)

(56) References Cited

U.S. PATENT DOCUMENTS

| | | | | |
|---|---|---|---|---|
| 2007/0181224 | A1 | 8/2007 | Marya et al. | |
| 2011/0067889 | A1 | 3/2011 | Marya et al. | |
| 2013/0269930 | A1 | 10/2013 | Adam | |
| 2014/0224506 | A1 | 8/2014 | Xu et al. | |
| 2014/0332233 | A1 | 11/2014 | Walton et al. | |
| 2015/0285026 | A1* | 10/2015 | Frazier ..... | E21B 33/1291 166/120 |

OTHER PUBLICATIONS

Office Action issued by the Polish Patent Office for Patent Application No. P-426008, dated Sep. 24, 2019, 6 pages.

* cited by examiner

RETAINING SEALING ELEMENT OF WELLBORE ISOLATION DEVICE WITH SLIP ELEMENTS

PRIORITY

The present application is a U.S. National Stage patent application of International Patent Application No. PCT/US2016/014225, filed on Jan. 21, 2016, the benefit of which is claimed and the disclosure of which is incorporated herein by reference in its entirety.

BACKGROUND

1. Field of the Invention

The present disclosure relates generally to equipment useful in operations related to subterranean wellbores, e.g., wellbores employed for oil and gas exploration, drilling and production. More particularly, embodiments of the disclosure relate an isolation device in which an expandable slip operates to limit the extrusion of the sealing member in a wellbore.

2. Background

In operations related to the production of hydrocarbons from subterranean geologic formations, a wide variety of downhole tools may be deployed into a wellbore. For example, wellbore isolation tools such as frac plugs, bridge plugs and packers may be employed to establish a seal within the wellbore. The isolation tools may include an elastomeric sealing element that engages a borehole wall, casing member or other tubular to thereby isolate a pressure above the isolation tool from a pressure below the isolation tool.

These isolation tools are generally run into an appropriate position in the wellbore and then the sealing element is radially expanded to thereby set the isolation tool in the wellbore. Often, the forces applied to set the isolation tool and/or the pressures held by the sealing element can be associated with an undesirable extrusion of the sealing element. This extrusion may adversely affect the temperature and pressure limits of the isolation tool. Cone-shaped extrusion limiters constructed of a relatively rigid material have been provided in direct or indirect contact with elastomeric material of the sealing element to reduce or limit the extrusion of the elastomeric material during various wellbore operations.

Once the wellbore operation is complete, the isolation member may be removed from the wellbore. Generally, the isolation tool may be characterized as retrievable or disposable. Retrievable isolation tools may be pulled out of the wellbore on a retrieval tool deployed on a wireline or other conveyance, and may be refurbished and/or reused. Some disposable isolation tools are arranged to be mechanically drilled or milled within the wellbore, and the cuttings carried out to the wellbore by circulating fluids through the wellbore. Other isolation tools may be constructed of dissolvable materials, such that fluids in the wellbore may cause the isolation tool to dissolve over a predetermined time interval. In some instances, extrusion limiters constructed of dissolvable materials have presented difficulties in manufacturing and have been prone to failure in operation.

BRIEF DESCRIPTION OF THE DRAWINGS

The disclosure is described in detail hereinafter on the basis of embodiments represented in the accompanying figures, in which.

DETAILED DESCRIPTION

In the following description, even though a Figure may depict an apparatus in a portion of a wellbore having a specific orientation, unless indicated otherwise, it should be understood by those skilled in the art that the apparatus according to the present disclosure may be equally well suited for use in wellbore portions having other orientations including vertical, slanted, horizontal, curved, etc. Likewise, unless otherwise noted, even though a Figure may depict an offshore operation, it should be understood by those skilled in the art that the apparatus according to the present disclosure is equally well suited for use in onshore or terrestrial operations. Further, unless otherwise noted, even though a Figure may depict a wellbore that is partially cased, it should be understood by those skilled in the art that the apparatus according to the present disclosure may be equally well suited for use in fully open-hole wellbores.

1. Description of Exemplary Embodiments

The present disclosure includes a downhole wellbore isolation tool having an elastomeric sealing element for engaging a casing member or another tubular member in a wellbore. The isolation tool also includes one or more expandable slips for gripping the tubular member and holding the isolation tool in place. The sealing element is in direct contact with the expandable slip elements mechanism such that the expandable slip limits, if not eliminates, unwanted extrusion of the sealing element. The arrangement of the sealing element in direct contact with the slip elements facilitates constructing the isolation tool from dissolvable metal materials, which facilitates removal of the isolation tool from the wellbore.

Figure 1:
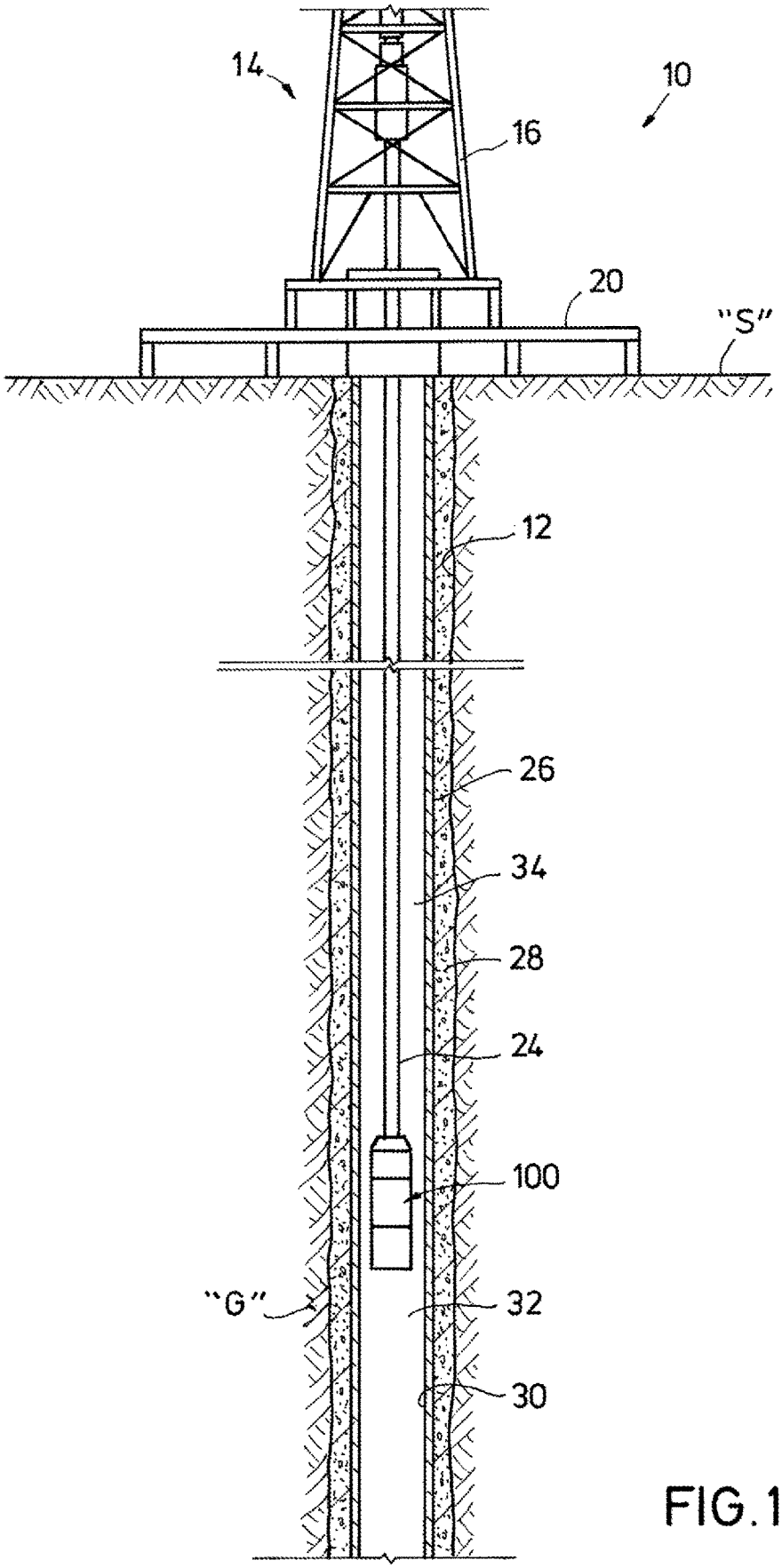
FIG. 1 is a partially cross-sectional side view of a wellbore system including an isolation tool being deployed in a wellbore in accordance with one or more example embodiments of the disclosure.

FIG. 1 is a partially cross-sectional side view of a wellbore system 10 including a wellbore isolation tool 100 being deployed in a wellbore 12 that extends through a geologic formation "G" in accordance with one or more example embodiments of the disclosure. The wellbore system 10 is one exemplary operating environment for the wellbore isolation tool 100 in which the wellbore 12 extends from a terrestrial surface location "S." In other embodiments, the wellbore isolation tool 100 may also have application in subsea or offshore well systems (not shown) where a wellbore extends from the sea floor. The illustrated wellbore system 10 includes a drilling rig 14 positioned at the surface location "S." The drilling rig 14 includes a derrick 16 with a rig floor 20. The derrick 16 facilitates manipulation of a conveyance 24, such as drill string, wireline, jointed pipe, or coiled tubing that extends downwardly from the derrick into the wellbore 12. The conveyance 24 is operable to carry the wellbore isolation tool 100 to a predetermined depth or another appropriate downhole location with the wellbore 12. The drilling rig 14 may include a motor driven winch and/or other associated equipment for raising and lowering the conveyance 24 to thereby position the wellbore isolation tool 100. While drilling rig 14 is one example of a stationary mechanism for manipulating the conveyance 24, one of ordinary skill in the art will readily appreciate that mobile workover rigs, well servicing units, and the like, could also be used to position the wellbore isolation tool 100 by raising and lowering the conveyance 24 within the wellbore 12.

In the illustrated embodiment, at least an upper portion of the wellbore 12 includes a casing string 26 therein. The casing string 26 is secured in the wellbore by a layer of cement 28 as recognized in the art. The wellbore isolation tool 100 is configured to engage an interior wall 30 of the casing string 26 and to form a sealing engagement therewith. In other embodiments, the wellbore isolation tool 100 may be configured to form a seal with the geologic formation "G" in an open-hole portion of the wellbore 12. In any event, the wellbore isolation tool 100 is operable to isolate a pressure in a first wellbore zone 32 arranged below the wellbore isolation tool 100 from the pressure in a second wellbore zone 34 above the wellbore isolation device. The wellbore isolation tool 100 may comprises a frac plug, a bridge plug, a packer, or another type of wellbore zonal isolation device.

Figure 2:
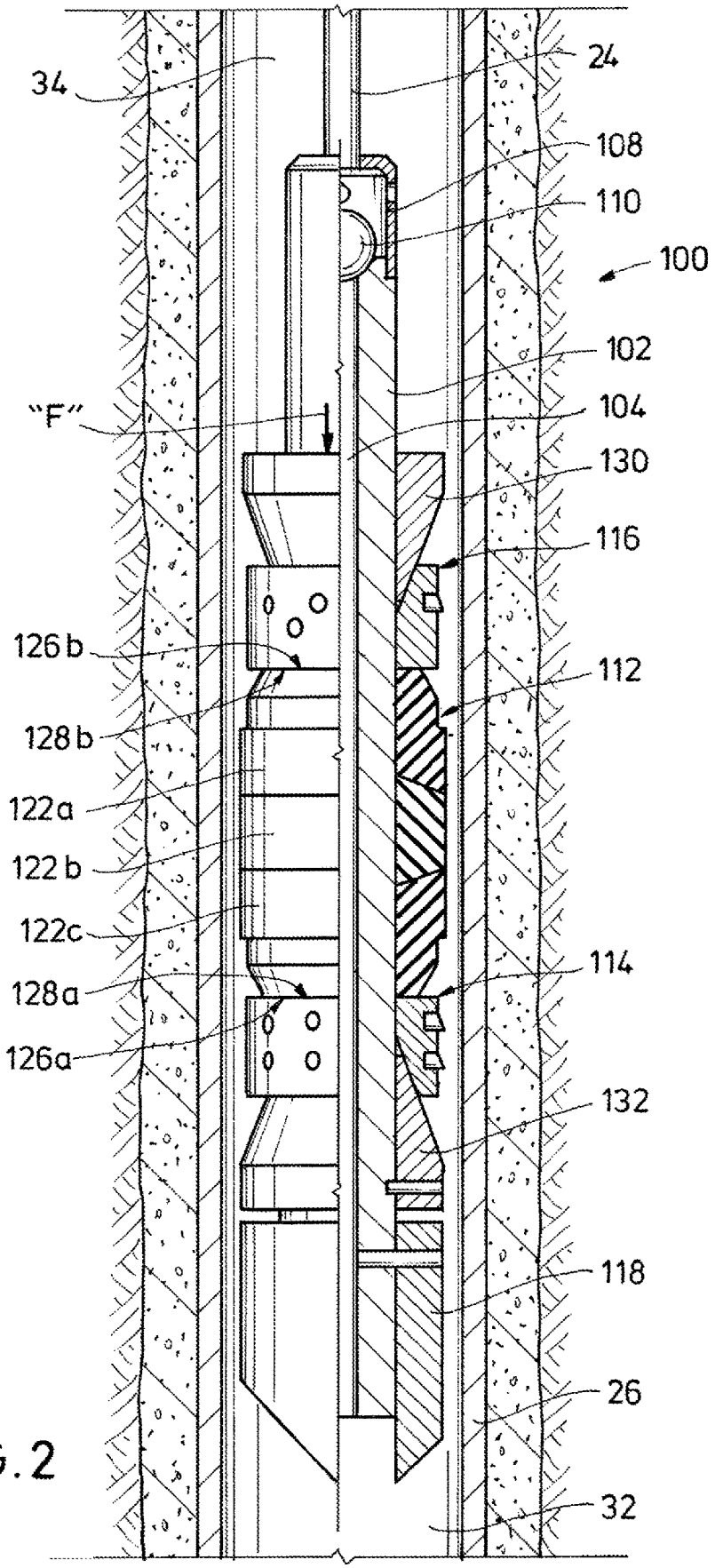
FIG. 2 is a partially cross-sectional side view of the isolation tool of FIG. 1 being run into the wellbore in an unexpanded configuration illustrating a sealing element in direct contact with an expandable slip mechanism of the isolation tool.

FIG. 2 is a partially cross-sectional side view of the isolation tool 100 being run into the wellbore 12 in an unexpanded configuration. Although the wellbore isolation tool 100 may take a variety of different forms, in the illustrated embodiment, the wellbore isolation tool 100 is constructed as plug that is used in a well stimulation/fracturing operation, commonly known as a "frac plug." The wellbore isolation tool 100 includes an elongate tubular mandrel 102 defining an axial flowbore 104 extending therethrough. A housing 108 is formed at the upper end of the mandrel 102 for retaining a ball 110 that acts as a one-way check valve. In particular, the ball 110 seals off the flowbore 104 to prevent flow downwardly therethrough, but permits flow upwardly through the flowbore 104. In other embodiments (not shown) the wellbore isolation tool 100 may comprise a "bridge plug," which generally does not permit flow therethrough in either direction. A bridge plug generally operates to completely isolate the first wellbore zone 32 below the isolation tool 100 from the second wellbore zone 34 above the wellbore isolation tool 100.

The mandrel 102 of the wellbore isolation tool 100 generally carries a packer assembly 112, a lower slip 114, an upper slip 116 and a tapered shoe 118. The packer assembly 112 includes at least one sealing element 122*a*, 122*b*, 122*c*, extending circumferentially around the mandrel 102. In the illustrated embodiment, the packer assembly 112 includes an upper sealing element 122*a*, a center sealing element 122*b*, and a lower sealing element 122*c*, each of which may be constructed of an elastomeric material. The sealing elements 122*a*, 122*b*, 122*c* may be constructed materials exhibiting a high tensile strength with sufficient elongation properties to form a seal with the casing string 26. In some example embodiments, suitable materials may exhibit a tensile strength greater than 2000 psi or 3000 psi and may include materials such as cast polyurethane, molded polyurethane and fiber-reinforced nitrile. In some example embodiments, one or more of the sealing elements 122*a*, 122*b*, 122*c* define a dissolvable sealing element configured to dissolve in wellbore fluids. A dissolvable sealing element 122*a*, 122*b*, 122 may be constructed of a hydrolytically degradable material such as elastomeric compounds that contain polyurethane, aliphatic polyesters, thiol, celloluse, acetate, polyvinyl acetate, polyethylene, polypropylene, polystyrene, natural rubber, polyvinyl alcohol, or combinations thereof. Aliphatic polyester has a hydrolysable ester bond and will degrade in water. Examples include polylactic acid, polyglycolic acid, polyhydroxyalkonate, and polycaprolactone.

One skilled in the art will recognize that more or fewer sealing elements 122*a*, 122*b*, 122*c* may be provided in other embodiments. The lower slip 114 is mounted around the mandrel 102 below the packer assembly 112 and the upper slip 116 is mounted around the mandrel above the packer assembly 112. As described in greater detail below, the lower and upper slips 114, 116 are in direct contact with the lower and upper sealing elements 122*c*, 122*a* respectively. In other embodiments, a single lower slip 114 may be provided, or any number of additional slips may be provided above and below the packer assembly 112. As described in greater detail below, the slips 114, 116 are generally operable to engage the casing string 26 to hold the wellbore isolation tool 100 in a desired position. The tapered shoe 118 is provided at the lower end of the mandrel 102 for guiding and protecting the wellbore isolation tool as it is lowered into the wellbore 12 with the conveyance 24.

At least some of the components comprising the wellbore isolation tool 100 are constructed of a dissolvable metal material. As used herein, a dissolvable metal includes any metal that has an average dissolution rate in excess of 0.01 $mg/cm^2/hr.$ at 200° F. in a 15% KCl solution. A component constructed of a dissolvable material may lose greater than 0.1% of its total mass per day at 200° F. in a 15% KCl solution. In some embodiments, the dissolvable metal material may include an aluminum alloy and/or a magnesium alloy. Magnesium alloys include those defined in ASTM standards AZ31 to ZK60. In some embodiments, the magnesium alloy is alloyed with a dopant selected from the group consisting of iron, nickel, copper and tin.

The dissolvable components of the wellbore isolation tool 100 may be configured to dissolve when exposed to a chemical solution, an ultraviolet light, a nuclear source, or a combination thereof. In some embodiments, an optional enclosure (not shown) may be provided on the mandrel 102 for storing an appropriate chemical solution until the chemical solution may be selectively released to dissolve the dissolvable components. In other embodiments, the dissolvable components may be dissolved in fluids present in the wellbore 12. These dissolvable components may be formed of any dissolvable material that is suitable for service in a downhole environment and that provides adequate strength to enable proper operation of the wellbore isolation tool 100. In addition to the dissolvable metal materials described above, and example dissolvable material may include an epoxy resin that dissolves when exposed to an acidic fluid. Another such material is a fiberglass that dissolves when exposed to an acid. Still another such material is a binding agent, such as an epoxy resin, for example, with glass reinforcement that dissolves when exposed to a chemical solution of caustic fluid or acidic fluid. The particular material used to construct the dissolvable components of the wellbore isolation tool 100 are customizable for operation in a particular pressure and temperature range, or to control the dissolution rate of the isolation tool 100 when exposed to a chemical solution, an ultraviolet light, a nuclear source, or a combination thereof. Thus, a dissolvable isolation tool 100 may operate as a 30-minute plug, a three-hour plug, or a three-day plug, for example, or any other timeframe desired by the operator. Alternatively, the chemical solution may be customized to control the dissolution rate of the wellbore isolation tool comprising a certain material matrix.

In some embodiments, the mandrel 102, packer assembly 112, the slips 114, 116 and the tapered shoe 118 are all constructed of a dissolvable material. In another embodiment, the mandrel 102 is constructed of a dissolvable material and the slips 114, 116 are constructed of a non-dissolving material, and in another embodiment the mandrel 102 is constructed of a non-dissolving material and the slips 114, 116 are constructed of a dissolvable material.

As illustrated in FIG. 2, the lower sealing element 122*c* has a first axial end 126*a* in direct contact with an axial abutment end 128*a* of the lower slip 114. Thus, the lower slip 114 may serve to limit the extrusion of the lower sealing element 122*c* in operation, e.g., extrusion induced by application of an axial setting force to the wellbore isolation tool 100. The lower sealing element 122*c* and the lower slip are arranged for radial expansion in response to an axial force applied to the wellbore isolation tool 100. For example, an axial force "F" applied to an upper slip wedge 130, e.g., by an activation tool (not shown) may be transferred through the upper slip 116, the packer assembly 112, and the lower slip 114 and to a lower slip wedge 132 that is affixed to the mandrel 102. The axial force "F" serves to drive relative axial movement of the slip wedges 130, 132 and the respective slips 116, 114 axially along the mandrel 102, and to thereby to radially expand the slips 114, 116. Also, the sealing elements 122*a*, 122*b*, 122*c* are axially compressed and radially expanded by the axial force "F," thereby moving the sealing elements 122*a*, 122*b*, 122*c* from an unset position (FIG. 2) wherein the sealing elements 122*a*, 122*b*, 122*c* are substantially spaced from the casing string 26 to a set position (FIG. 3) in which the sealing elements 122*a*, 122*b*, 122*c* are in sealing engagement with the casing string 26. The sealing elements 122*a*, 122*b*, 122*c* of the packer assembly 112 and the upper and lower slips 114, 116 may be set by various other mechanisms recognized in the art.

The upper slip 116 includes downward facing abutment surface 128*b* in direct contact with the upper axial end 126*b* of the elastomeric sealing element 122*a*. Thus, the upper slip 116 may serve to limit any upward extrusion of the upper seal element 122*a*.

Figure 3:
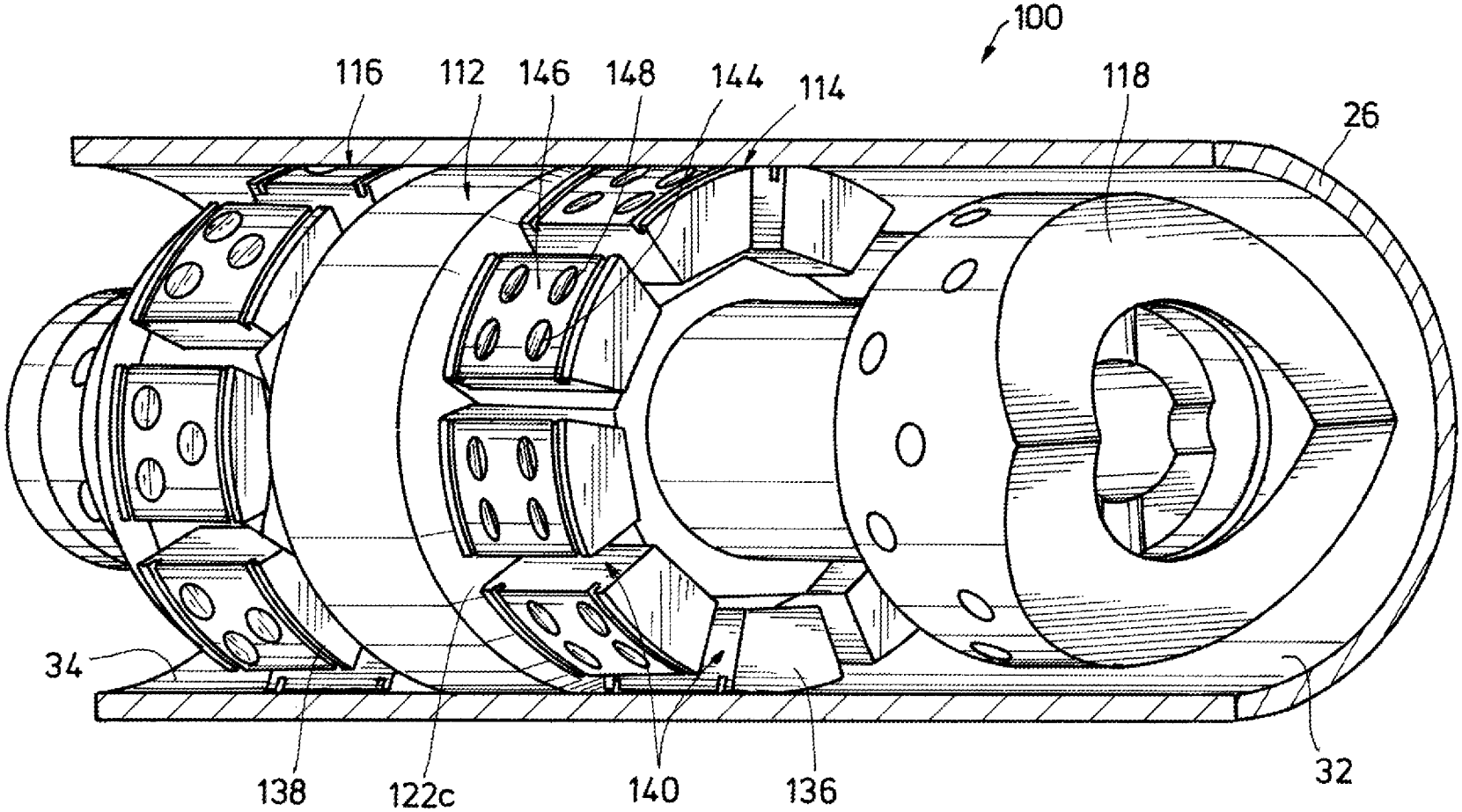
FIG. 3 is a partially cross-sectional perspective view of the isolation tool in an expanded configuration illustrating an extrusion of the sealing element into the expandable slip mechanism.

FIG. 3 is a partially cross-sectional perspective view of the wellbore isolation tool 100 in an expanded configuration wherein at least one of the sealing elements 122*a*, 122*b*, 122*c* engages the casing string 26 and wherein the slips 114, 116 are radially expanded to grip the casing string 26. The lower slip 114 is constructed of a plurality of slip elements 136 circumferentially spaced about the mandrel 102, and the upper slip 116 is constructed of a plurality of slip elements 138 circumferentially spaced about the mandrel 102. In other embodiments (not shown) lower and upper slips 114, 116 may be constructed as fracturing slips. Generally, fracturing slips may be formed of a single piece of material with axial relief grooves machined therein, which may facilitate separation of individual slip elements as the fracturing slip is expanded. In the embodiment illustrated in FIG. 3, the lower sealing element 122*c* is illustrated as having flowed into gaps 140 defined between the slip elements 136 of the lower slip 114 under the influence of the axial force "F."

Each of the slip elements of the 136 of the lower slip 114 (as well as the slip elements 138 of the upper slip 116) include a plurality of inserts 144 extending radially outwardly past a radially outermost surface 146 of the slip element 136. The inserts 144 are angled such that a lower gripping edge 148 protrudes from the outermost surface 146 and penetrates the casing string 26 when the slip 114 is radially expanded. In other embodiments (not shown), one or more of the inserts 144 are angled such that an upper gripping edge is defined. The orientation of the inserts 144 may be such that penetration of the inserts into the casing string 26 is minimal. For example the inserts may be angled at an angle in the range of about 5° to about 25° and may protrude from the radially outermost surface 146 by a distance in the range of about 0.000 inches to about 0.100 inches. By providing a large number of inserts 144 over the length and circumference of the slip elements 136, the inserts 144 will be able to only minimally penetrate the casing sting 26 and will still hold the wellbore isolation tool 100 in place. In some embodiments, the inserts are constructed of a relatively hard material, such as tungsten carbide, to facilitate gripping a casing string 26, which may be constructed of steel, for example. The slip elements 136, 138 and/or the inserts 144 may be constructed of dissolvable metal materials in some embodiments. In some embodiments, the slip elements 136 include a metal button or insert 144 inserted into the dissolvable metal material to protrude at an angle from a radially outer surface thereof to grip the casing In the example embodiment illustrated, the upper and lower slips 116, 114 may comprise dissolving metal button slips. In other embodiments, the upper and lower slips may comprise metal wicker slips, as appreciated by those skilled in the art. In still other embodiments, composite and/or ceramic materials may be included in the construction of slip elements 136 and or the lower and upper slips 114, 116 generally. The size and shape of the slip elements 136, 138 are generally well suited for construction with dissolvable materials such that the slip elements 136, 138 may suitably perform the functions of gripping the casing string 26 and limiting the extrusion of the sealing members 122*a*, 122*b*, 122*c* in harsh wellbore conditions. For example, a dissolving metal wellbore isolation tool 100 may be constructed for maintaining a 10,000 psi pressure differential between wellbore zones 32, 34 at 150° F. Employing the slips 114, 116 for both functions makes efficient use of limited space in a wellbore system 10 (FIG. 1).

2. Additional Embodiments

Figure 4:
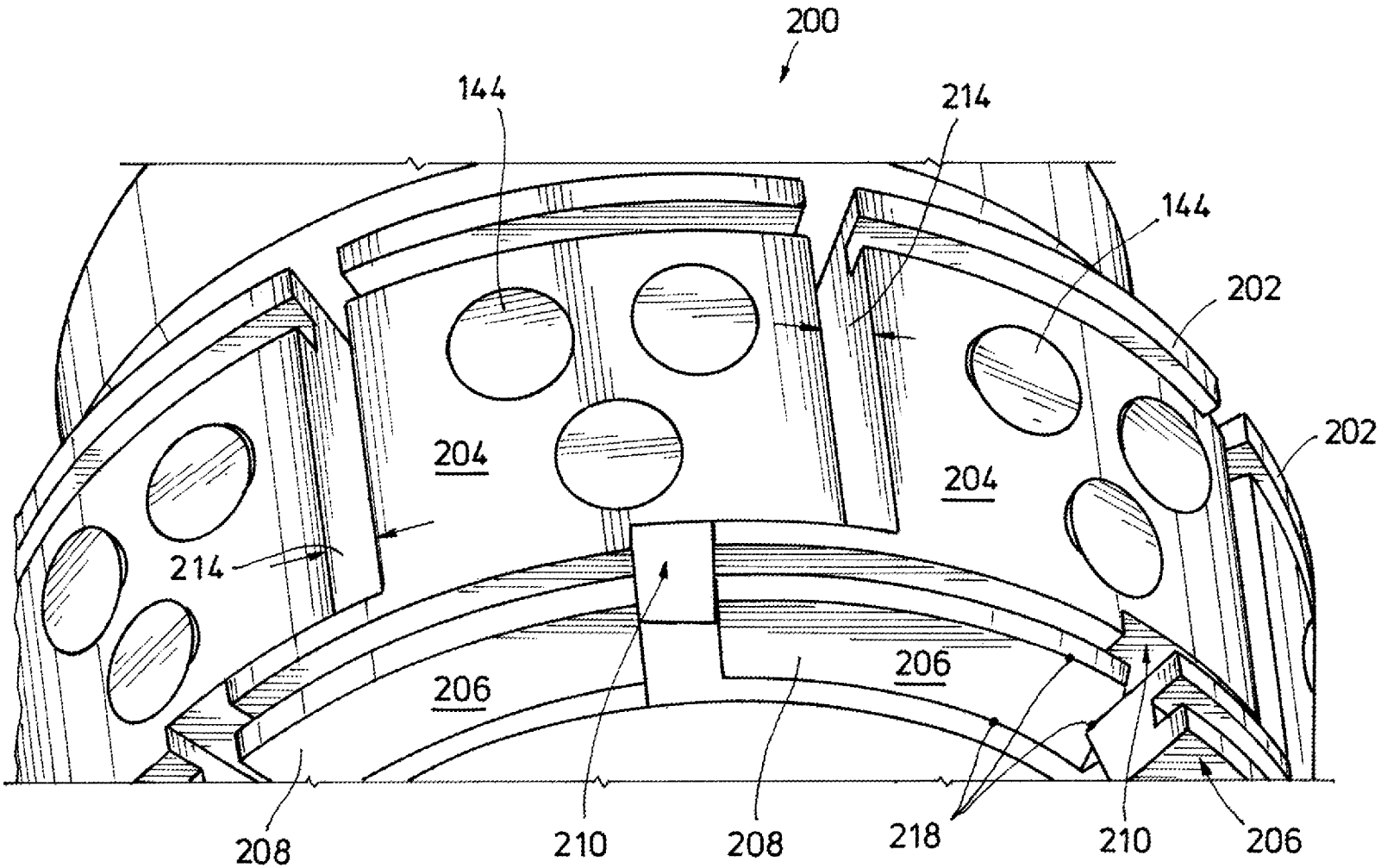
FIG. 4 is a partial perspective view of an alternate expandable slip mechanism including slip elements with circumferentially overlapping tabs in accordance with alternate embodiments of the of the disclosure.

FIG. 4 is a partial perspective view of an expandable slip mechanism 200 in accordance with alternate embodiments of the disclosure. The expandable slip mechanism 200 includes a plurality of circumferentially spaced slip elements 202 each including a radially outermost surface 204 and an axial abutment surface 206. The radially outermost surface 204 may include at least one insert 144 protruding therefrom for gripping a casing string 26 (FIG. 3), and the axial abutment surface 206 is arranged for engaging a sealing element 122*c* (FIG. 2), for example. Each of the slip elements 202 includes a circumferential tab 208 overlapping a circumferentially adjacent slip element 202, and the slip elements 202 define shoulder 210 that is overlapped by the circumferential tab 208 of an adjacent slip element 202. Gaps 214 defined between the slip elements 202 are shaped such that the axial extrusion of the sealing element 122*c* may be limited to the shoulders 210 on the slip elements 202.

The axial abutment surface 206 includes various edges 218 and corners that may generate high stresses at the contact points with the sealing element 122. These corners 218 may be chamfered and/or rounded reduce the resulting stress between the mating components, and thereby increase the amount of time the slip elements 202 may preclude excessive flow of the seal element 122*c* at a given temperature and/or increase the temperature at which excessive flow is precluded by the slip elements 202. Another variable that may enhance the ability of the slip mechanism 200 to retain the may be the number of circumferentially spaced slip elements 202. For example, a greater number of slip elements 202 may reduce the size of each of the gaps 214 defined between the slip elements 202. In some example embodiments, ten (10) circumferentially spaced slip elements 202 may be provided, although more or fewer slip elements are also contemplated.

3. Example Methods of Operation

Figure 5:
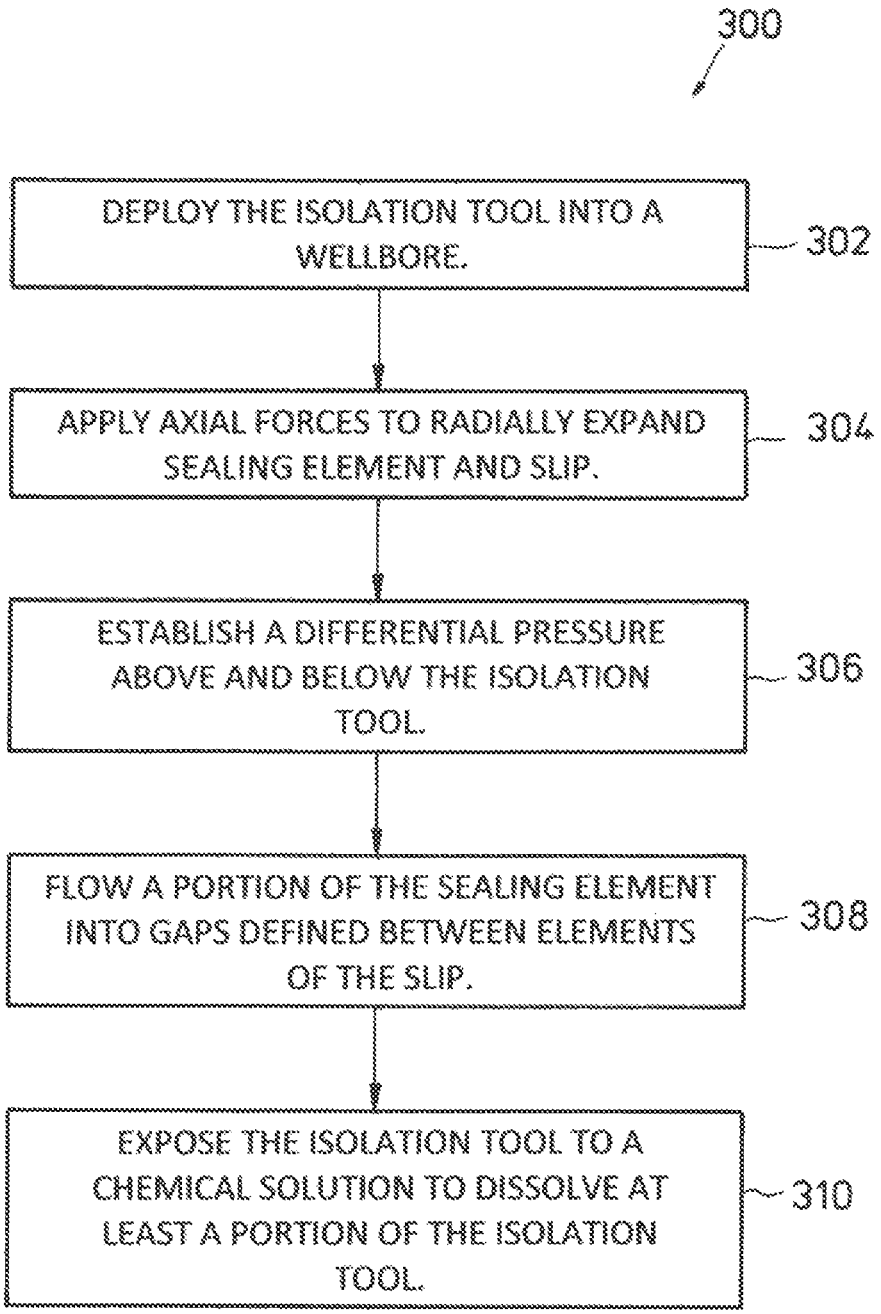
FIG. 5 is flowchart illustrating an operational procedure for deploying, using and removing the isolation tool of FIG. 1 in accordance with one or more exemplary embodiments of the disclosure.

FIG. 5 is a flowchart illustrating an operational procedure 300 for deploying, using and removing a wellbore isolation tool 100 (FIG. 1) in accordance with one or more exemplary embodiments of the disclosure. With reference to FIG. 5, and continued reference to FIGS. 1 through 3, the operational procedure 300 begins at step 302 by deploying the isolation tool 100 into a wellbore 12. The isolation tool 100 is may be lowered on any suitable conveyance 24 such as coiled tubing or a wireline. As the isolation tool 100 is lowered to a desired location in the wellbore, the axial end 126*a* of the lower sealing element 122*c* is direct contact with the abutment end 128*a* of the lower slip 114. Similarly, the upper sealing element 122*a* is in direct contact with the upper slip 116.

Next at step 304, once the wellbore isolation tool 100 reaches the desired location in the wellbore 12, the packer assembly 112 and slips 114, 116 are set in a conventional manner, thereby wellbore zone 32, 34. In some embodiments an axial force "F" is applied to the wellbore isolation tool to set the packer assembly 112 and slips 114, 116. The force "F" may cause the lower slip 114 to move downwardly over the mandrel 102 and lower slip wedge 132, thereby urging each slip element 136 radially outwardly to expanding the lower slip 114 and grip the casing string 26 with the inserts 144. Similarly, the upper slip wedge 130 is urged downwardly over the mandrel 102 and into the upper slip 116 to radially expand the upper slip. The axial force "F" also compresses the packer assembly 112 in an axial direction, causing the sealing elements 122*a*, 122*b*, 122*c* to radially expand and form a sealing engagement with the casing string 26. The wellbore zones 32, 34 defined below and above the wellbore isolation tool 100 are thereby fluidly isolated from one another. Once the wellbore isolation tool 100 is set in the wellbore, the conveyance 24 may be decoupled from the wellbore isolation tool 100 and pulled from the wellbore 12.

At step 306, a pressure differential may be established between the wellbore zones 32, 34 below and above the wellbore isolation tool 100. The pressure differential may be established by flowing fluid into one zone 32, 34 from the geologic formation "G" and/or from the surface location "S" depending on the wellbore operation being performed. In some embodiments, a pressure differential of 10,000 psi may be established with the higher pressure established within the second wellbore zone 34 above the wellbore isolation tool 100. This higher pressure above the wellbore isolation tool 100 may cause a portion of the lower sealing element 122*c* to flow (step 308) downwardly into gaps 140 defied between the slip elements 136 of the loser slip 114. The lower slip 114 retains the sealing element 122*c* and limits the extrusion of the sealing element 122*c* caused by the pressure differential, the axial force "F" applied to set the wellbore isolation tool, or other conditions present in the wellbore 12.

Next, at step 310, the wellbore isolation tool 100 may be exposed to a chemical solution to dissolve or accelerate the dissolution of at least a portion of the wellbore isolation tool 100. The chemical solution may be provided from the surface location "S," or carried by the mandrel 102, in some instances. The chemical solution may also include fluids present in the wellbore such as production fluids that flow into the wellbore from the geologic formation "G", fracing fluids or other chemical solutions related to a particular operation for which the wellbore isolation tool is employed. In some embodiments, the mandrel 102, slips 114, 116 and packer assembly 112 are all induced to dissolve in the wellbore 12, thereby fluidly recoupling the wellbore zones 32, 34. In other embodiments, one or more selected components of the wellbore isolation tool 100 are constructed of non-dissolving materials, and may be removed from the wellbore 12 on a conveyance 24, or may remain in the wellbore 12.

4. Aspects of the Disclosure

The aspects of the disclosure described in this section are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a wellbore isolation tool including a mandrel defining a longitudinal axis, a sealing element disposed about the mandrel and at least one expandable slip disposed about the mandrel. The sealing element has first and second axial ends, and is selectively expandable in a radial direction from an unset position to a set position. The at least one expandable slip has an axial abutment end in direct contact with one of the first and second axial ends of the sealing element.

In one or more exemplary embodiments, at least one of the sealing element and the slip is constructed of a dissolvable material. In some embodiments, the expandable slip is constructed of a dissolvable material and the dissolvable material includes at least one of an aluminum alloy and a magnesium alloy. And in some embodiments, the dissolvable material is a magnesium alloy that is alloyed with a dopant including at least one of iron, nickel, copper and tin.

In some embodiments, the expandable slip is a metal button slip including a plurality of inserts or buttons extending radially outwardly from an outer surface of the expandable slip to engage a casing member and hold the wellbore isolation member in place when the expandable slip is expanded. In some embodiments, the sealing element is constructed from a dissolvable elastomer, and in some embodiments the dissolvable elastomer includes at least one of an aliphatic polyester, a polyurethane, and an acrylic rubber. In some example embodiments, the at least one expandable slip includes a plurality of slip elements circumferentially spaced about the mandrel, and each slip element of the plurality of slip elements may include an end surface defining a portion of the axial abutment end of the expandable slip that is in direct contact with one of the first and second axial ends of the sealing element.

In one or more embodiments, the wellbore isolation tool further includes a slip wedge operably associated with the plurality of slip elements for urging each slip element of the plurality of slip elements radially outwardly to engage a casing string circumscribing the at least one expandable slip. In some embodiments, end surface of each slip element of the plurality of slip elements includes a circumferential tab overlapping a circumferentially adjacent slip element of the plurality of slip elements. In some embodiments, the end surface of each slip element of the plurality of slip elements includes at least one chamfered or rounded edge in direct contact with the sealing element.

In another aspect, the disclosure is directed to a method of performing a downhole operation with a wellbore isolation tool. The method includes (a) deploying the wellbore isolation tool into a wellbore on a mandrel, wherein the mandrel carries a selectively expandable sealing element disposed about the mandrel and having at least one axial end in direct contact with an abutment end of at least one expandable slip disposed about the mandrel, and (b) applying an axial force to the wellbore isolation tool to thereby radially expand the sealing element and the at least one expandable slip in the wellbore, and to axially press the sealing element and the at least one expandable slip together.

In some embodiments, the method further includes dissolving at least one of the sealing element and the expandable slip within the wellbore by exposing the wellbore isolation tool to a chemical solution. In one or more exemplary embodiments, the method further includes establishing a differential pressure above and below the wellbore isolation tool by engaging the sealing element with a casing string or member circumscribing the sealing element in the wellbore. In some embodiments, establishing the differential pressure presses the sealing element and the at least one expandable slip together and further flows an elastomeric material of the expandable sealing element into gaps defined between a plurality of circumferentially spaced slip elements of the expandable slip.

In one or more example embodiments, establishing the differential pressure further comprises flowing a fluid into the wellbore from a surface location or from a geologic formation through which the wellbore extends. In some embodiments, flowing the fluid into the wellbore further comprises exposing a dissolvable metal material of the at least one expandable slip to a chemical solution to thereby accelerate the dissolution of the at least one expandable slip.

In another aspect, the disclosure is directed to a wellbore isolation apparatus for use in a subterranean well having a casing therein. The apparatus includes a mandrel, an elastomeric sealing element disposed about the mandrel, an upper slip disposed on the mandrel for gripping the casing, and a lower slip disposed on the mandrel for gripping the casing. The elastomeric sealing element has upper and lower axial ends, and is selectively expandable in a radial direction from an unset position to a set position in response to an axial force applied between the upper and lower axial ends. The upper slip includes downward facing abutment surface in direct contact with the upper axial end of the elastomeric sealing element and the lower slip includes an upward facing abutment surface in direct contact with the lower axial end of the elastomeric sealing element.

In one or more exemplary embodiments, at least one of the upper slip and the lower slip is constructed of a dissolvable metal material having an average dissolution rate in excess of 0.01 $mg/cm^2/hr$. at 200° F. in a 15% KCl solution. In some embodiments, the at least one of the upper slip and the lower slip is a metal button slip and metal wicker slip. In some example embodiments, the at least one of the upper slip and the lower slip includes a plurality of slip elements circumferentially spaced about the mandrel such that the at least one of the upper slip and the lower slip is radially expandable by radial movement of the slip elements. In some exemplary embodiments, the at least one of the upper slip and the lower slip is a metal button slip, and wherein at least one of the slip elements includes a metal button inserted into the dissolvable metal material and protruding at an angle from a radially outer surface thereof to grip the casing.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A wellbore isolation tool comprising:

a mandrel defining a longitudinal axis;

a sealing element disposed about the mandrel and having first and second axial ends, the sealing element being selectively expandable in a radial direction from an unset position to a set position; and at least one expandable slip disposed about the mandrel, the at least one expandable slip having an axial abutment end in direct contact with one of the first and second axial ends of the sealing element the at least one expandable slip including a plurality of slip elements circumferentially spaced about the mandrel, wherein each slip element includes an end surface defining a portion of the axial abutment end of the expandable slip that is in direct contact with one of the first and second axial ends of the sealing element, and wherein at least a portion of the end surface of each slip element is part of a circumferential tab that overlaps a shoulder of a circumferentially adjacent slip element of the plurality of slip elements to limit flow of the expandable sealing element into circumferential gaps defined between the slip elements.

2. The wellbore isolation tool of claim 1, wherein at least one of the sealing element and the slip is constructed of a dissolvable material.

3. The wellbore isolation tool of claim 2, wherein the expandable slip is constructed of a dissolvable material and wherein the dissolvable material includes at least one of an aluminum alloy and a magnesium alloy.

4. The wellbore isolation tool of claim 3, wherein the dissolvable material is a magnesium alloy that is alloyed with a dopant including at least one of iron, nickel, copper and tin.

5. The wellbore isolation tool of claim 3, wherein the expandable slip is a metal button slip including a plurality of inserts or buttons extending radially outwardly from an outer surface of the expandable slip to engage a casing member and hold the wellbore isolation member in place when the expandable slip is expanded.

6. The wellbore isolation tool of claim 2, wherein the sealing element constructed from a dissolvable elastomer and wherein the dissolvable elastomer includes at least one of an aliphatic polyester, a polyurethane, and an acrylic rubber.

7. The wellbore isolation tool of claim 1, further comprising a slip wedge operably associated with the plurality of slip elements for urging each slip element of the plurality of slip elements radially outwardly to engage a casing circumscribing the at least one expandable slip.

8. The wellbore isolation tool of claim 1, wherein the end surface of each slip element of the plurality of slip elements includes at least one chamfered, rounded or radiused edge in direct contact with the sealing element.

9. A method of performing a downhole operation with a wellbore isolation tool, the method comprising:

deploying the wellbore isolation tool into a wellbore on a mandrel, wherein the mandrel carries a selectively expandable sealing element disposed about the mandrel and having at least one axial end in direct contact with an abutment end of at least one expandable slip disposed about the mandrel;

applying an axial force to the wellbore isolation tool to thereby radially expand the sealing element and the at least one expandable slip in the wellbore, and to axially press the sealing element and the at least one expandable slip together;

establishing a differential pressure above and below the wellbore isolation tool by engaging the sealing element with a casing member circumscribing the sealing element in the wellbore, wherein establishing the differential pressure presses the sealing element and the at least one expandable slip together and further flows an elastomeric material of the expandable sealing element into gaps defined between a plurality of circumferentially spaced slip elements of the expandable slip; and limiting the flow of the elastomeric material into the gaps by overlapping a circumferential tab of each slip element of the plurality of circumferentially spaced slip elements over a shoulder of a circumferentially adjacent slip element of the plurality of circumferentially spaced slip elements.

10. The method of claim 9, further comprising dissolving at least one of the sealing element and the expandable slip within the wellbore by exposing the wellbore isolation tool to a chemical solution.

11. The method of claim 9, wherein establishing the differential pressure further comprises flowing a fluid into the wellbore from a surface location or from a geologic formation through which the wellbore extends, and wherein flowing the fluid into the wellbore further comprises exposing a dissolvable metal material of the at least one expandable slip to a chemical solution to thereby accelerate the dissolution of the at least one expandable slip.

12. A wellbore isolation apparatus for use in a subterranean well having a casing therein, the apparatus comprising:

a mandrel;

an elastomeric sealing element disposed about the mandrel and having upper and lower axial ends, the sealing element being selectively expandable in a radial direction from an unset position to a set position in response to an axial force applied between the upper and lower axial ends;

an upper slip disposed on the mandrel for gripping the casing, the upper slip including a downward facing abutment surface in direct contact with the upper axial end of elastomeric sealing element; and a lower slip disposed on the mandrel for gripping the casing, the lower slip including an upward facing abutment surface in direct contact with the lower axial end of the elastomeric sealing element, wherein at least one of the upper slip and the lower slip includes a plurality of slip elements circumferentially spaced about the mandrel, wherein each slip element includes an end surface that is in direct contact with one of the upper and lower axial ends of the sealing element, and wherein at least a portion of the end surface of each slip element is part of a circumferential tab that overlaps a shoulder of a circumferentially adjacent slip element of the plurality of slip elements to limit flow of the expandable sealing element into circumferential gaps defined between the plurality of slip elements.

13. The wellbore isolation apparatus of claim 12 wherein at least one of the upper slip and the lower slip is constructed of a dissolvable metal material having an average dissolution rate in excess of 0.01 $mg/cm^2/hr.$ at 200° F. in a 15% KCl solution.

14. The wellbore isolation apparatus of claim 13, wherein the at least one of the upper slip and the lower slip is a metal button slip and/or a metal wicker slip.

15. The wellbore isolation apparatus of claim 14, wherein the at plurality of slip elements circumferentially spaced about the mandrel cause the at least one of the upper slip and the lower slip to be radially expandable by radial movement of the slip elements.

16. The wellbore isolation apparatus of claim 15, wherein the at least one of the upper slip and the lower slip is a metal button slip, and wherein at least one of the slip elements includes a metal button inserted into the dissolvable metal material and protruding at an angle from a radially outer surface thereof to grip the casing.

* * * * *